US012667882B2

(12) United States Patent
Ziliani

(10) Patent No.: US 12,667,882 B2
(45) Date of Patent: Jun. 30, 2026

(54) MACHINE FOR DEFORMATION MACHINING OF A TUBE AND/OR OF A COMPONENT ON THE TUBE

(71) Applicant: OP S.R.L., Brescia (IT)

(72) Inventor: Massimo Ziliani, Brescia (IT)

(73) Assignee: OP S.R.L., Brescia (IT)

( * ) Notice: Subject to any disclaimer, the term of this patent is extended or adjusted under 35 U.S.C. 154(b) by 255 days.

(21) Appl. No.: 18/283,518

(22) PCT Filed: Feb. 2, 2022

(86) PCT No.: PCT/IB2022/050899
§ 371 (c)(1),
(2) Date: Sep. 22, 2023

(87) PCT Pub. No.: WO2022/219419
PCT Pub. Date: Oct. 20, 2022

(65) Prior Publication Data

US 2024/0165689 A1 May 23, 2024

(30) Foreign Application Priority Data

Apr. 14, 2021 (IT) ..... 102021000009389

(51) Int. Cl.
*B21D 39/08* (2006.01)
*B21D 37/06* (2006.01)

(52) U.S. Cl.
CPC ..... *B21D 39/08* (2013.01); *B21D 37/06* (2013.01)

(58) Field of Classification Search
CPC ..... B21D 7/02; B21D 7/024; B21D 39/08; B21D 37/06; B21D 37/04; B21D 37/12
See application file for complete search history.

(56) References Cited

U.S. PATENT DOCUMENTS

2002/0104361 A1* 8/2002 Broggi ..... B21D 7/024 72/306
2004/0065131 A1* 4/2004 Schmauder ..... B21D 7/024 72/149

(Continued)

FOREIGN PATENT DOCUMENTS

EP 0116111 A2 8/1984

OTHER PUBLICATIONS

1 International Search Report for International Patent Application No. PCT/IB2022/050899, mailed May 12, 2022.

*Primary Examiner* — Teresa M Ekiert
(74) *Attorney, Agent, or Firm* — CANTOR COLBURN LLP

(57) ABSTRACT

A machine for deformation machinings of a tube and/or of a component to be mounted to said tube, including a support frame, a bracket projecting in a cantilever manner from the support frame and a deformation unit engaged rotationally free with the bracket, the deformation unit in turn including a thrust group and a support head, the thrust group having a thrust actuator extending along an actuator axis, where the support head faces the thrust group and is suitable to support a tube portion during the machining, where the thrust group further includes a deformation head extending along a head axis offset with respect to the actuator axis, the offsetting between the actuator axis and the head axis is suitable to allow the deformation of the tube and/or of the component also when an end of the tube is close to a curvature of the tube itself.

8 Claims, 5 Drawing Sheets

(56) References Cited

U.S. PATENT DOCUMENTS

| | | | | |
|---|---|---|---|---|
| 2009/0173127 | A1* | 7/2009 | Pace | B21D 7/12<br>72/149 |
| 2014/0150230 | A1 | 6/2014 | Spink | |
| 2014/0305176 | A1 | 10/2014 | Aravindan et al. | |

* cited by examiner

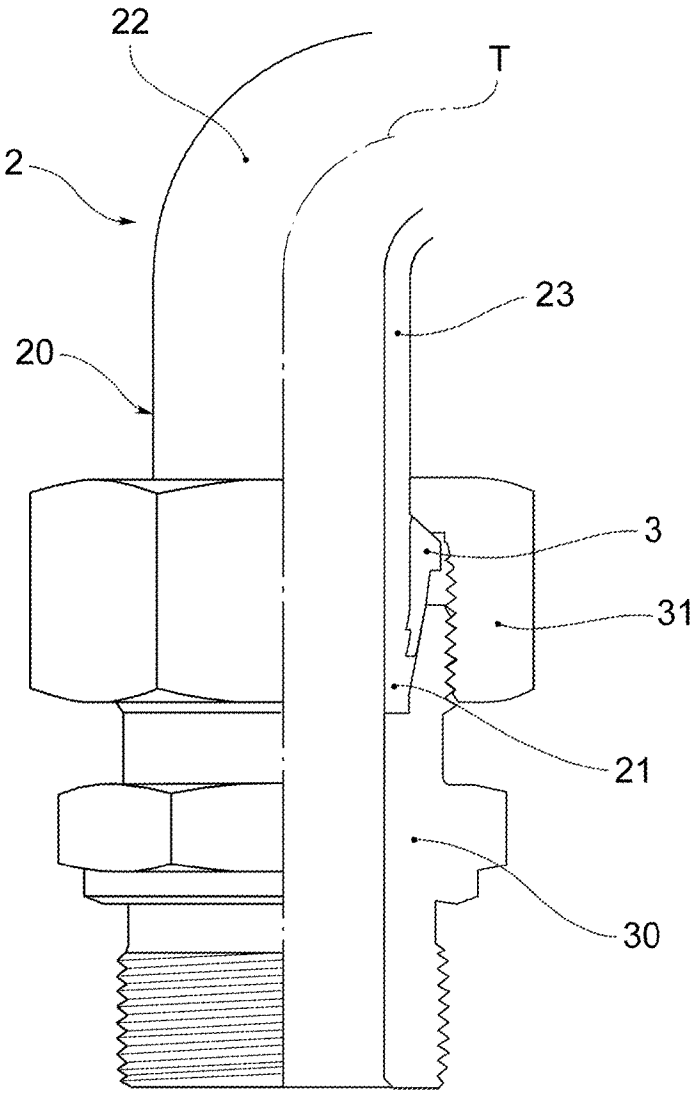
FIG.7 - prior art
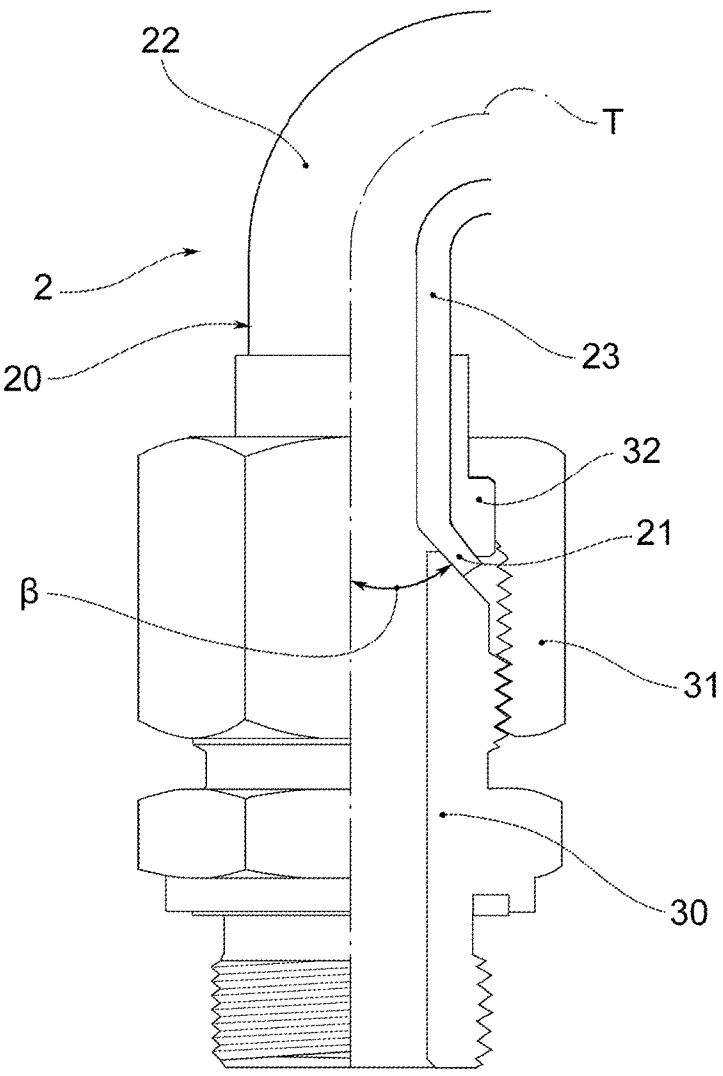
FIG.6 - prior art

MACHINE FOR DEFORMATION MACHINING OF A TUBE AND/OR OF A COMPONENT ON THE TUBE

TECHNICAL FIELD

The present disclosure relates to the field of machines for the plastic deformation of tubes, for example shaped rigid tubes or combined flexible and rigid tubes, both very common in the automotive industry.

In particular, the present disclosure relates to a machine for deformation machinings of a tube or deformation of a component, such as a ring or a bush, to be mounted to said tube.

BACKGROUND

On the market and in the prior art, machines for deforming tubes or components to be keyed onto tubes are widely used.

In particular, the plastic deformation of shaped rigid tubes, i.e. tubes having a plurality of curves along their length extension, or of combined flexible and rigid tubes, i.e. tubes that alternate flexible portions with rigid portions, mainly concerns flaring and/or pre-assembly machinings of rings on the tube.

Flaring machinings consist in deforming one end of the tube into a cone shape with a flare angle width of 37°, where such width is measured with respect to a tube axis.

In particular and in accordance with the ISO 8434-2 or SAE J514 standard, the flaring process allows the tube to be prepared to be coupled with a fitting body, so as to create a mechanical fitting for high-pressure fluid-dynamic connections.

As illustrated in FIG. 6, the flaring of the tube is coupled with a counter-shaped conical surface obtained on the fitting body. The connection is guaranteed by a tightening nut and a pressure ring housed inside it, wherein the tightening nut engages an external thread obtained on the fitting body.

On the other hand, the pre-assembly operations consist in fitting a ring (or a bush) on the tube and homogeneously deforming such ring (or bush) in order to fix it to the tube and make the tube and the ring integral with each other.

Preferably, the pre-assembly machinings concern the deformations of DIN rings to be mounted to tubes, for example for DIN 2353 or ISO 8434-1 fittings.

FIG. 7 illustrates a mechanical fitting according to the DIN 2353 or ISO 8434-1 standard, wherein a component, for example a ring provided with a toothing, is radially deformed during the deformation machinings so that the toothing of the component penetrates in the tube and makes the component integral with the tube. The radial deformation of the component defines a flared portion converging towards the inside of the tube which is engaged by a respective counter-shaped conical surface obtained on the fitting body. The connection between the tube and the fitting body is guaranteed by the tightening nut which is screwed onto the external thread obtained on the ncing body.

In the case illustrated in FIG. 7, the fitting according to the ISO 8434-1 or DIN 2353 standard is a mechanical fitting of the cutting ring type with double clamping on the cold-drawn weldless tube.

The cutting ring allows you to quickly create removable tubes, avoids welding, threading and flaring, simplifying the construction of complex hydraulic systems as much as possible. During the tightening caused by the tightening nut, the cutting ring deforms according to the bore of the 24° cone of the fitting and penetrates into the steel tube, causing two deep incisions, the first of which, visible for the lifting of an external edge on the diameter of the tube, guarantees the tightness and the anti-slip of the ring from the tube, the second (not visible) helps to equally distribute the forces over the whole ring, prevents vibrations from reaching the first incision and stops at a predetermined value of the tube clamp.

Despite the plurality of machines available today, the world of industry, in particular that of the automotive industry, requires deformation machinings to be carried out on tubes having a plurality of curves. In other words, the tube is repeatedly bent so as to make it assume a desired shape before being subjected to the flaring and/or pre-assembly machinings.

In order to meet the miniaturization needs of hydraulic systems, the tubes can also be subjected to extreme bends, up to 180°, in order to obtain a compact shape suitable for the required purpose.

However, due to the shape of the tube and its curvatures, the subsequent plastic deformation machinings can be extremely complex. In particular, due to its shape, the tube can collide with parts of the machine and prevent the end of the tube to be machined from being correctly positioned on the machine. In other words, the shape of the tube itself hinders or prevents the tube from being put into the machine and its machining.

Disadvantageously, although the machines available on the market are versatile, not all tube shapes with the bends required by industry today can be machined.

In order to overcome this limit, and subject the tube to flaring and/or pre-assembly machinings of a component on the tube, the man skilled in the art uses tools for manual, and not mechanized, deformation of the tube and/or component. It is clear that the use of such tools requires skilled labor, extremely long machining time and high costs.

BRIEF SUMMARY

The present disclosure proposes a machine for deformation machinings of a tube, or of a component to be mounted to said tube, capable of at least partially obviating the drawbacks mentioned above.

In particular, the present disclosure is directed to machining a tube whose end to be deformed is close to a curvature of the tube. For the purposes of the present discussion, the term "close" means that the end to be deformed is "in proximity" to the curvature.

BRIEF DESCRIPTION OF THE DRAWINGS

The features and the advantages of the machine according to the disclosure shall be made readily apparent from the following description of preferred embodiment examples thereof, provided purely by way of a non-limiting example, with reference to the accompanying figures, in which:

FIG. 6 illustrates an example of ISO 8434-2 or SAE J514 fitting according to the prior art, and FIG. 7 illustrates an example of DIN 2353 or ISO 8434-1 fitting according to the prior art.

DETAILED DESCRIPTION

Figure 1:
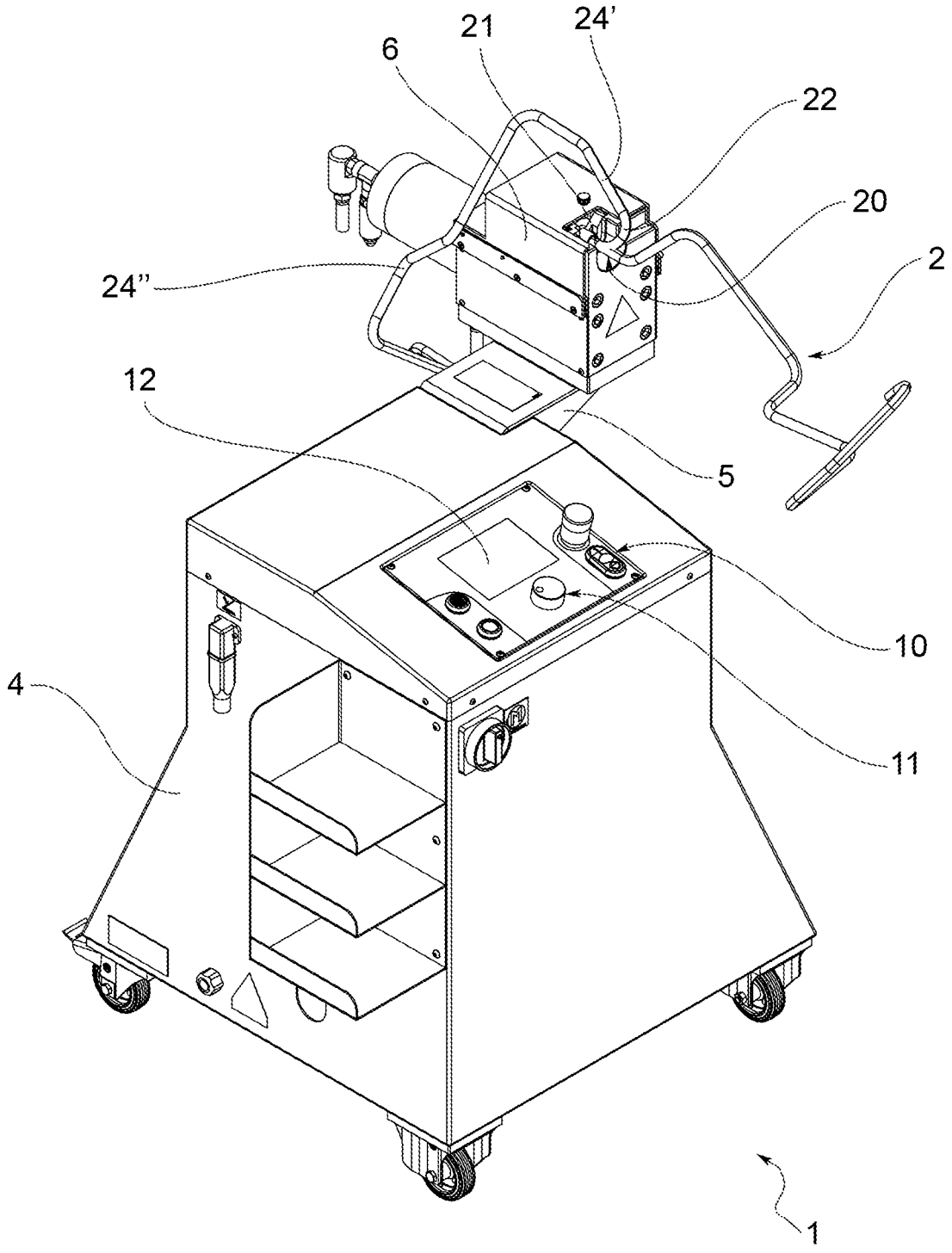
FIG. 1 is a perspective view of the machine in one embodiment.

In the following description, elements common to the various embodiments represented in the drawings are indicated with the same reference numerals.

In said drawings, reference numeral 1 indicates a machine for deformation machinings of a tube 2, and/or deformation of a component 3 to be mounted to said tube 2, according to the disclosure as a whole.

For example, the component 3 is a ring or a bush.

In this case, the component 3 is mounted to the tube 2 and is made integral therewith.

In a general embodiment, the machine comprises a support frame 4, a bracket 5 projecting in a cantilever manner from the support frame and a deformation unit 6.

In particular, the deformation unit 6 allows the execution of flaring machinings of the tube 2 or pre-assembly of the component 3 on the tube 2.

According to an aspect of the disclosure, the deformation unit 6 is engaged rotationally free with the bracket 5 and comprises a thrust group 7 and a support head 8. In other words, the deformation unit 6, being engaged with the bracket 5, protrudes laterally from the support frame 4 and is rotatable with respect to the bracket 5 which is instead fixed to the support frame 4; in this regard, consider the machine 1 in operating conditions, i.e. resting on a horizontal base plane.

The thrust group 7 in turn comprises a thrust actuator 70 extending along an actuator axis C.

The support head 8 faces the thrust group 7 and is suitable to support a tube portion 20 during the machining.

In detail, the support head 8 has a seat 80 in which a plurality of selectors can be inserted, where each selector of said plurality of selectors is provided with a housing having a diameter substantially equal to that of the tube portion 20 to be supported during the deformation machining. In other words, the support head 8 cooperates with the thrust group 7 for the execution of the flaring and/or pre-assembly machinings of the tube portion 20, optionally provided with the component 3 fitted externally to the tube 2.

The thrust group 7 also comprises a deformation head 72 extending along a head axis H. The head axis H and the actuator axis C are offset from each other, so as to make the machine 1 suitable to perform the deformation of the tube 2 and/or component 3 even where one end 21 of the tube 2 is close to a curvature 22 of the tube 2. In other words, the offsetting between the actuator axis C and the head axis H is suitable to allow the deformation of the tube 2 and/or of the component 3 also when the end 21 of the tube 2 is close to the curvature 22.

In particular, the end 21 can be subjected to flaring or pre-assembly machining of the component 3 on the same end 21 of the tube 2.

In this case, the deformation head 72 carries out the deformation machinings of the tube 2 and/or of the component 3 to be mounted to the tube. Therefore, the deformation head 72 is configured as a tool for deformation machinings.

Advantageously, compared to the prior art, where the head axis and the actuator axis are coaxial, in the machine object of the present disclosure such head and actuator axes are offset from each other, so as to make the machine more flexible and versatile than those currently on the market.

Preferably, the thrust actuator 70 is a cylinder.

According to an embodiment, the thrust group 7 further comprises a thrust flange 71 moved by the thrust actuator 70 and extending along a flange axis F incident on the actuator axis C.

Preferably, the flange axis F is orthogonal to the actuator axis C.

According to an embodiment, the deformation head 72 is removably engageable with the thrust flange 71. The head axis H is parallel to the actuator axis C and is spaced apart from such actuator axis C, so as to achieve a misalignment between the actuator axis C and the head axis H.

Figure 1A:
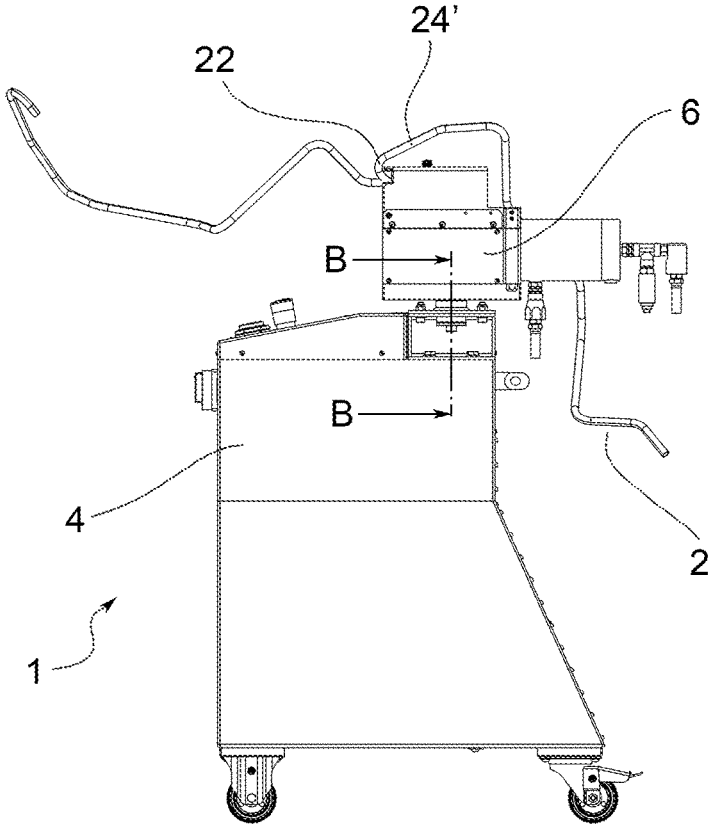
FIG. 1*a* is a lateral view of the machine of FIG. 1.
Figure 1B:
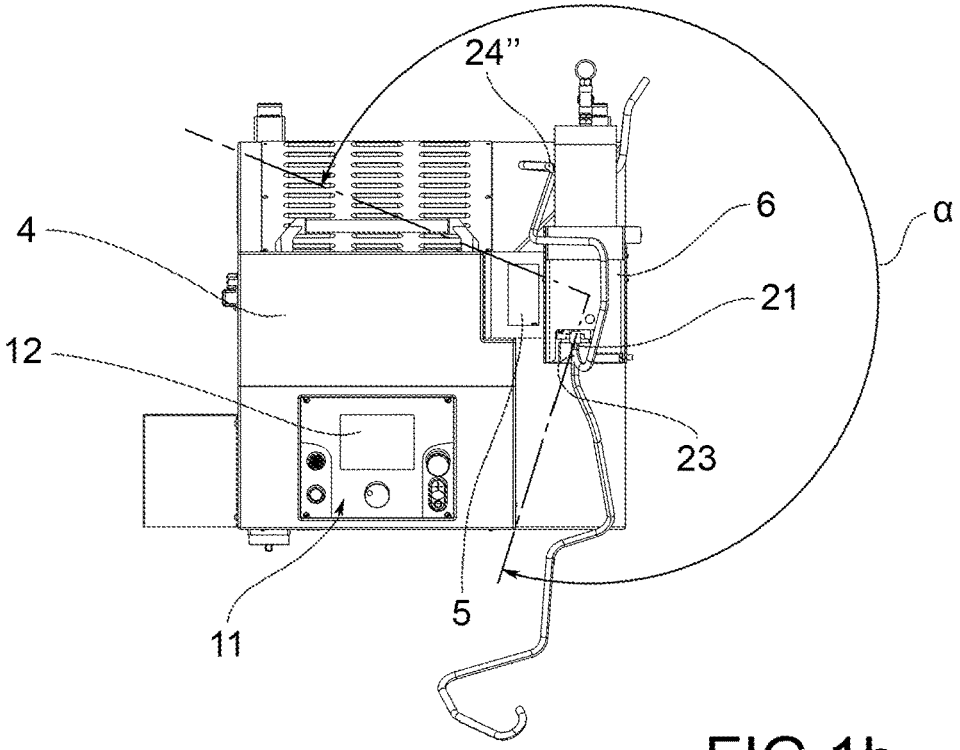
FIG. 1*b* is a top view of the machine of FIG. 1.
Figure 2:
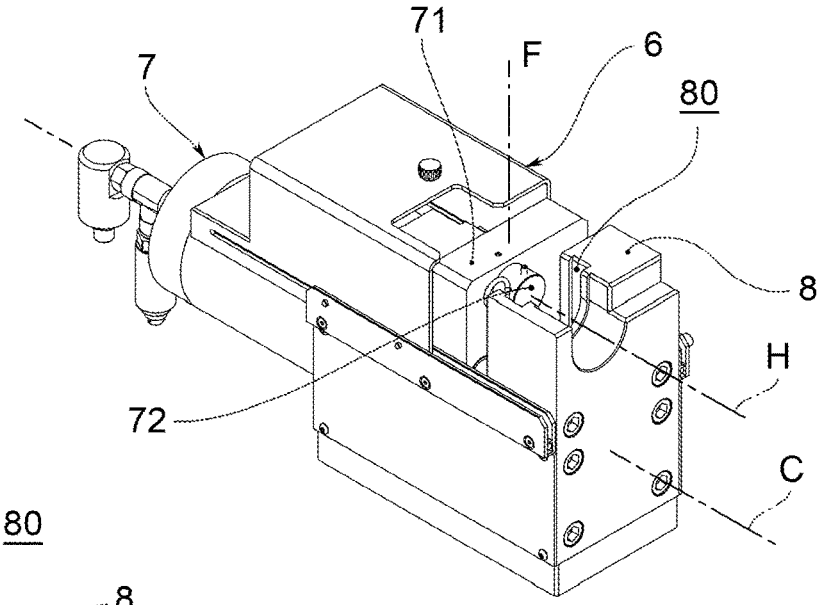
FIG. 2 is a perspective view of a deformation unit in one embodiment.

According to the accompanying FIGS. 1-1*b*, it should be observed that the deformation unit 6, being engaged with the bracket 5, protrudes from the support frame 4. Considering the machine 1 in operating conditions, the deformation unit 6 extends laterally with respect to the support frame 4.

Please note that the offsetting between the actuator axis C and the head axis H and the lateral protrusion of the deformation unit 6 with respect to the support frame 4 produces a synergistic effect, as the spacing of the deformation head 72 from the actuator axis C and the possibility of rotating the deformation unit 6, which protrudes laterally from the support frame 4, allow tubes of any shape currently required by the market to be subjected to deformation.

FIG. 6 shows an example of an ISO 8434-2 mechanical fitting, wherein the end 21 is spaced from the curvature 22 of the tube by means of a straight tube portion 23. The end 21 has a flaring, the flaring angle β whereof is measured with respect to a tube axis T. In addition to the tube 2, the mechanical fitting comprises a fitting body 30 provided with a counter-shaped conical surface which mates with the flaring of the tube 2. The connection between the tube 2 and the fitting body 30 is guaranteed by the engagement of a tightening nut 31 with an external thread obtained on the fitting body 30.

The tightening nut 31 is connected to the end 21 by means of a pressure ring 32, housed inside the tightening nut 31, which ensures the alignment of the fitting body 30 along the tube axis T. Furthermore, the pressure ring 32 supports the tube in operation, attenuates vibrations and prevents damage to the tube during the tightening step.

FIG. 7 shows an example of a mechanical fitting according to the DIN 2353 or ISO 8434-1 standard which, in addition to the tube 2, includes the component 3 radially deformed during the pre-assembly machining, the tightening nut 31 and the fitting body 30.

In this case, the component 3 is a cutting ring provided with a toothing with double clamping which, following the radial pre-assembly deformation, remains adhered to the tube, as the toothing penetrates the tube 2 making the component 3 integral with the tube itself. The radial deformation of the component 3 defines a flared portion converging towards the tube axis T which is engaged by a respective counter-shaped conical surface obtained on the fitting body 30. Such counter-shaped conical surface is inclined by approximately 24° with respect to the tube axis T. Finally, the connection between the tube 2 and the fitting body 30 is guaranteed by the tightening nut 31 which is screwed onto the external thread obtained on the fitting body.

Advantageously, the machine object of the present disclosure allows tubes with extremely complex shapes, provided with a plurality of bends, to be deformed.

Figure 4:
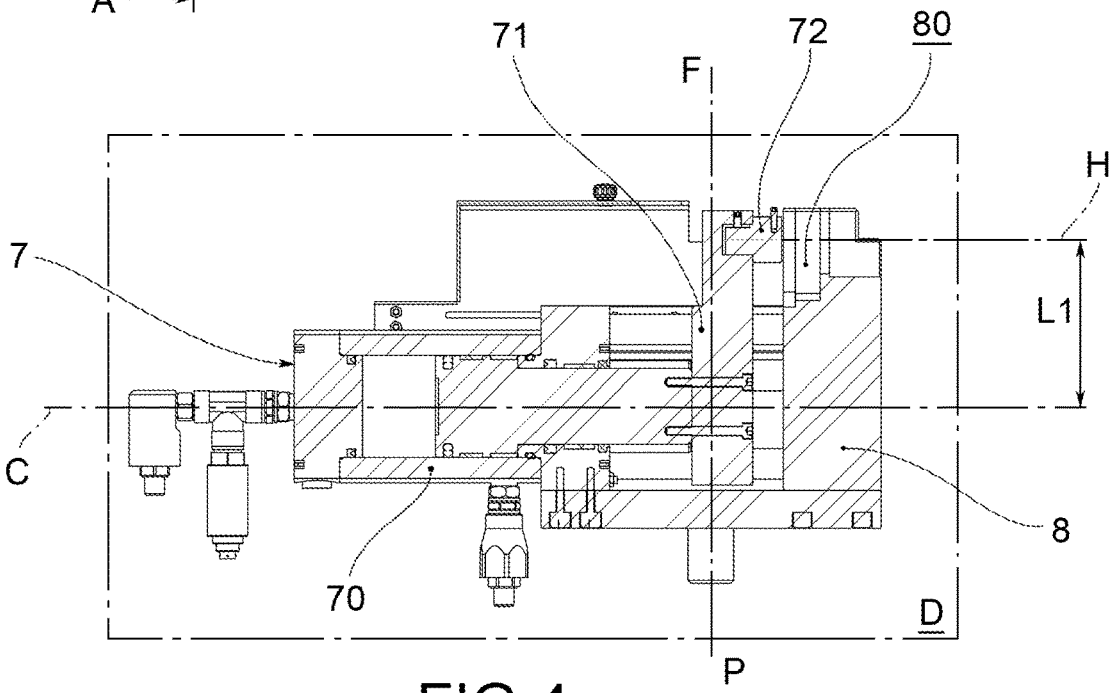
FIG. 4 is a sectional view, taken along line A-A of FIG. 3, which represents the deformation unit.

According to an embodiment shown in FIG. 4, the offsetting between the actuator axis C and the head axis H is defined by a first misalignment length L1.

According to an embodiment, the actuator axis C and the flange axis F lie on a midsagittal plane M. The head axis H instead lies on an imaginary deformation plane D which is parallel to the midsagittal plane M and is spaced apart from such midsagittal plane M.

In one embodiment, the first misalignment length L1 is measured on the imaginary deformation plane D.

Figure 3:
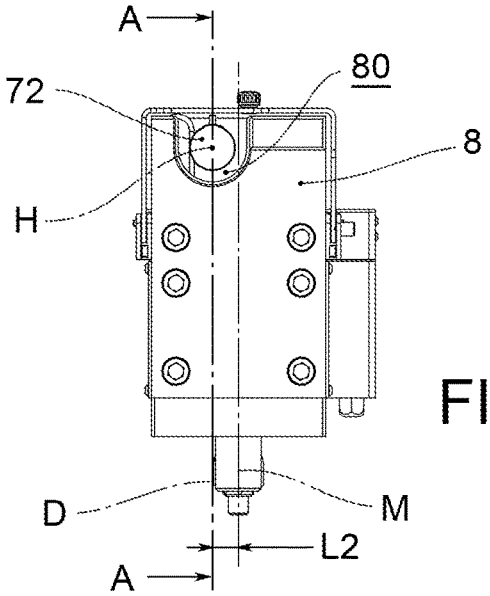
FIG. 3 is a front view of the deformation unit of FIG. 2.

According to an embodiment shown in FIG. 3, the distance between the imaginary deformation plane D and the midsagittal plane M is defined by a second misalignment length L2.

It should be noted that the spacing of the imaginary deformation plane D from the midsagittal plane M further amplifies the synergistic effect deriving from the combination of the offset between the actuator axis C and the head axis H with the lateral projection of the deformation unit 6 with respect to the support frame 4. In other words, the combination of three factors, such as the first misalignment length L1, the second misalignment length L2 and the rotationally free engagement of the deformation unit 6 with the bracket 5, where the bracket protrudes laterally from the frame support 4, produces a further amplified synergistic effect which makes the machine 1 extremely versatile and flexible, as it widens the range of possible tube shapes to be subjected to deformation.

According to an embodiment, the first misalignment length L1 and the second misalignment length L2 are measured along directions orthogonal to each other.

Figure 5:
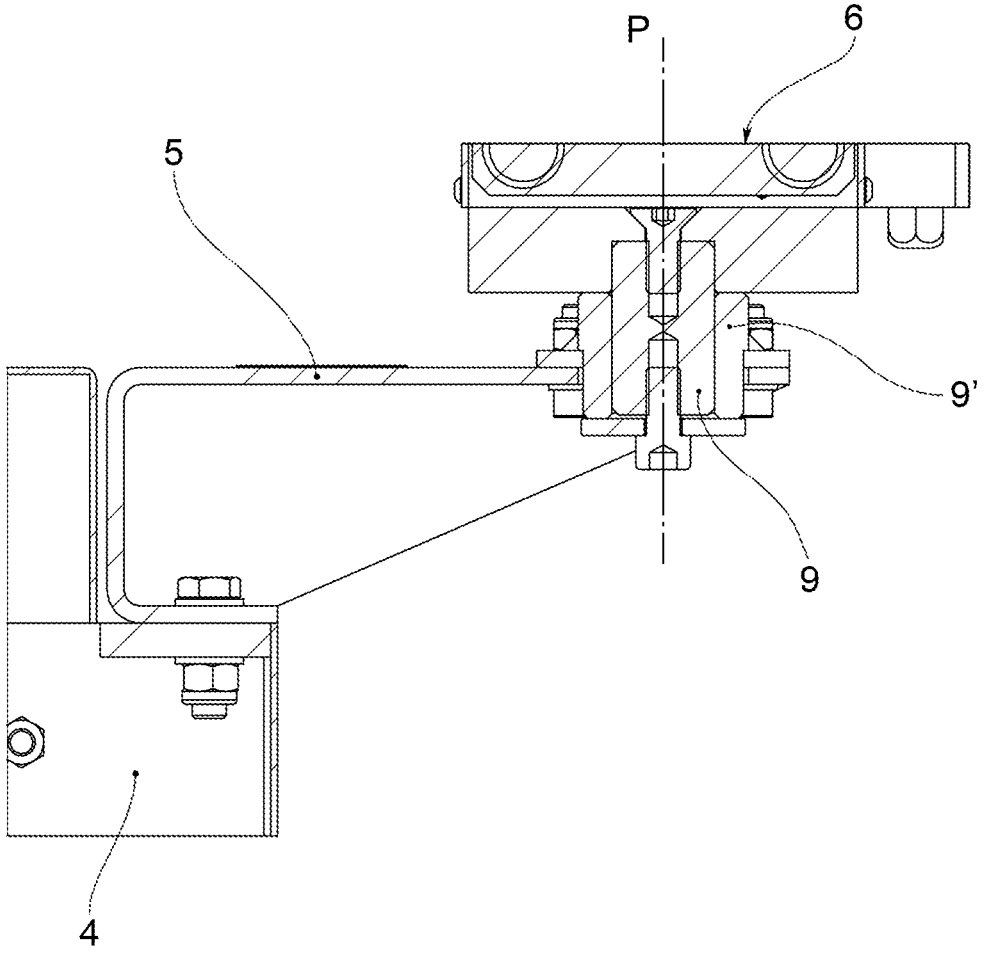
FIG. 5 is a sectional view, taken along line B-B of FIG. 1*a*, in which the detail of a pivot which engages a bracket is represented.

According to the embodiments shown in FIGS. 4 and 5, the deformation unit 6 engages the bracket 5 through a pivot 9 which enables the rotation of the deformation unit 6 about a pivot axis P.

Preferably, the pivot 9 is cylindrical, is housed in a bush 9' and is made integral therewith; moreover, the bush 9' is free to rotate with respect to the bracket 5 around the pivot axis P.

According to an embodiment and to FIG. 1*b*, the deformation unit 6 can rotate around the pivot axis P by an angle $\alpha$ which is substantially comprised between 0° and 360°, that is a round angle.

According to an embodiment, the machine 1 further comprises a management unit 10 suitable to command the deformation machinings. Such management unit 10 is provided with a command panel 11 which can be operated manually by an operator. Preferably, the command panel 11 also comprises a touch user interface 12.

In the accompanying FIGS. 1-1*b*, a plurality of near-collision portions 24', 24" are visible, that is, portions of the tube which would collide with the members of the machine 1 if at least one of the three synergy factors were missing. In particular, in FIG. 1*a* a first near-collision portion 24' is visible which would touch the machine 1 if the head axis H were collinear to the actuator axis C. Instead, in FIG. 1*b* a second near-collusion portion 24" is visible which would touch the machine 1 if the imaginary deformation plane D were coplanar to the midsagittal plane M.

Innovatively, the machine for deformation machinings of the tube, and/or of a component to be mounted to the tube, fulfills the intended purpose.

Advantageously, the machine object of the present disclosure allows the automated machining of the tube shapes currently required by the market. Such automated, non-manual machining is obtainable by virtue of the synergy between the first misalignment length and the fact that the deformation unit is rotatable and protrudes laterally from the support frame. In particular, two synergy factors are sufficient, namely the first misalignment length and the rotation of the laterally protruding deformation unit, to deform the tube shapes currently required by the industry.

According to an advantageous aspect, the machine object of the present disclosure allows the range of tube shapes to be deformed to be widened thanks to a third factor, i.e. the second misalignment length, which further amplifies the synergistic effect due to the combination of the first misalignment length and the deformation unit engaged rotationally free to the bracket and protruding laterally.

According to a still further advantageous aspect, the machine object of the present disclosure prevents the tube from colliding with the parts of the machine while the tube is put into the machine. In detail, such collisions are avoided by virtue of the deformation unit, which can be rotated and protrudes laterally from the support frame by means of the bracket, and by virtue of the double misalignment, i.e. by virtue of the first and second misalignment length.

A man skilled in the art may make several changes, adjustments and replacements of elements with other functionally equivalent ones to the embodiments of the machine according to the disclosure in order to meet incidental needs, without departing from the scope of the following claims. Each of the features described as belonging to a possible embodiment may be obtained independently of the other described embodiments.

For example, the scope of protection of the present disclosure is considered extended to any type of component, for example in the form of a ring or bush, to be mounted to and made integral with any type of tube.

Furthermore, the scope of protection is not limited to technical applications relating to the aforementioned DIN, ISO and SAE standards; in this case, these regulations have been mentioned only for explanatory and non-limiting purposes.

The invention claimed is:

1. A machine for deformation machinings of a tube and/or deformation of a component, such as a ring or a bush, to be mounted to said tube, the machine comprising:

a support frame;

a bracket projecting in a cantilever manner from the support frame;

a deformation unit engaged rotationally free with the bracket and comprising:

i) a thrust group comprising a thrust actuator extending along an actuator axis;

ii) a support head facing the thrust group and suitable to support a tube portion during the machining, wherein the thrust group also comprises a deformation head extending along a head axis, wherein said head axis and said actuator axis are offset from each other, so as to make the machine suitable to perform the deformation of the tube and/or component even where one end of the tube is close to a curvature of the tube.

2. A machine according to claim 1, wherein the thrust group further comprises a thrust flange moved by the thrust actuator and extending along a flange axis incident on the actuator axis.

3. A machine according to claim 2, wherein the deformation head is removably engageable with the thrust flange, and wherein the head axis is parallel to the actuator axis and is spaced apart therefrom.

4. A machine according to claim 1, wherein the offsetting between the actuator axis and the head axis is defined by a first misalignment length.

5. A machine according to claim 2, wherein the actuator axis and the flange axis lie on a midsagittal plane, and wherein the head axis lies on an imaginary deformation plane which is parallel to the midsagittal plane and is spaced apart therefrom.

6. A machine according to claim 4, wherein the first misalignment length is measured on an imaginary deformation plane.

7. A machine according to claim 5, wherein the distance between the imaginary deformation plane and the midsagittal plane is defined by a second misalignment length.

8. A machine according to claim 1, wherein the deformation unit engages the bracket through a pivot which enables the rotation of the deformation unit about a pivot axis.

* * * * *